United States Patent [19]

Bromley

[11] 4,249,744

[45] Feb. 10, 1981

[54] TWO-PLAYER ELECTRONIC SPORTS ACTION GAME

[75] Inventor: Eric Bromley, West Simsbury, Conn.

[73] Assignee: Coleco Industries, Inc., Hartford, Conn.

[21] Appl. No.: 15,130

[22] Filed: Feb. 26, 1979

[51] Int. Cl.[3] ..... A63F 9/00

[52] U.S. Cl. ..... 273/859; 273/313

[58] Field of Search ..... 273/1 E, 85 G, 86 R, 273/86 B, 88, 94, DIG. 28; 364/410

[56] References Cited

U.S. PATENT DOCUMENTS

| | | | |
|---|---|---|---|
| 2,843,381 | 7/1958 | Davis | 273/1 E |
| 2,883,193 | 4/1959 | Iannone | 273/88 |
| 3,337,218 | 8/1967 | Hurley | 273/85 G |
| 3,413,002 | 11/1968 | Welch | 273/93 |
| 3,556,525 | 1/1971 | Pegg | 273/94 |
| 3,583,538 | 6/1971 | Hurley | 273/85 G |
| 3,606,329 | 9/1971 | Wilson | 273/88 |
| 3,630,522 | 12/1971 | Bear | 273/94 |
| 3,790,170 | 2/1974 | Alexander | 273/88 |
| 3,874,669 | 4/1975 | Ariano et al. | 273/85 G |
| 4,006,474 | 2/1977 | Lukkarila | 273/85 G |
| 4,017,075 | 4/1977 | Wilson | 273/94 |
| 4,026,555 | 5/1977 | Kirschner et al. | 273/85 G |
| 4,053,740 | 10/1977 | Rosenthal | 273/85 G |
| 4,089,524 | 5/1978 | Hauck | 273/85 G |
| 4,093,223 | 6/1978 | Wilke | 273/85 G |
| 4,116,441 | 7/1978 | Runte et al. | 273/85 G |
| 4,162,792 | 7/1979 | Chang et al. | 273/85 G |

FOREIGN PATENT DOCUMENTS

| | | | |
|---|---|---|---|
| 2617147 | 10/1977 | Fed. Rep. of Germany | 273/DIG. 28 |
| 2807231 | 8/1978 | Fed. Rep. of Germany | 273/DIG. 28 |
| 2826731 | 12/1978 | Fed. Rep. of Germany | 273/DIG. 28 |
| 4737274 | 11/1975 | Japan | 273/DIG. 28 |

OTHER PUBLICATIONS

*Electronic Design;* May 10, 1977, p. 21.

*Funkschau,* Jul. 4, 1975, pp. 91–94.

*Mattel Electronics ™ Football Game Instructions,* 1977, pp. 1–5.

*Primary Examiner*—Vance Y. Hum

[57] ABSTRACT

A hand-held electronic device provides for simultaneous operation of a sports-action game by two operators. A housing contains a display panel and two seven-segment displays that provide status information. Operational circuitry is contained in the housing that controls the seven-segment displays and the display panel. Offensive and defensive control boards are provided on either side of the display panel to enter offensive and defensive commands into the operational circuitry. The display panel includes five stationary offensive-player positions and a goal position, and an LED is provided at each of the positions to indicate that the goal has been reached or that the offensive player is in possession of a game object. Furthermore, pass paths of LEDs are provided between pairs of the offensive players, and shot paths of LEDS are provided between some of the offensive players and the goal. The operational circuitry simulates passes by consecutive illumination of the LEDs in a pass path, and it simulates shots by consecutive illumination of LEDs in a shot path.

LEDs are also provided in a defensive-player path and in a further path that simulates a goalie or a target, depending on the game being simulated. Coincidence between the defensive player and the game object is detected by the operational circuitry, and successful or unsuccessful shots and passes are simulated as a result, depending on the game being simulated.

23 Claims, 9 Drawing Figures

TWO-PLAYER ELECTRONIC SPORTS ACTION GAME

BACKGROUND OF THE INVENTION

The present invention relates to the field of electronic games. In particular, it pertains to a hand-held electronic device for simulating a sports-action game.

The electronic game has recently enjoyed a large measure of consumer acceptance. Some of the electronic games have been the video games, which employ a cathode-ray tube and various programming circuitry and other circuitry for developing the video signal that is used to simulate the game on the cathode-ray tube. These games tend to be the more expensive of the electronic games. The more inexpensive, of which the game of the present invention is an example, are the hand-held games, which do not employ cathode-ray tubes and usually include discrete devices such as light-emitting diodes for simulating the sports action. The popularity of the hand-held game is based to some extent on its convenience and low cost. It does not require connection to a television set, and it is easily carried around. However, it is also a condition of consumer acceptance that, despite the simplicity that is the basis for its low cost, an engaging game be provided. It is therefore desirable in devices simulating sports-action games that a variety of game situations and strategies be possible.

Another difference between the video games and the typical electronic game of the hand-held variety is that there tends to be less interchangeability between parts in the hand-held games. In video games it is not unusual for the same type of modulator and the same type of composite-video circuitry to be used for several different games, and the television sets in such games are, of course, interchangeable. Furthermore, the actual computing circuitry for simulating the games is sometimes also common, with only a change in program making the difference between, say, a simulated tennis game and a simulated hockey game. Possibly because of their use of discrete visual-image devices in layouts peculiar to each game, the use of common parts has not been typical in the hand-held game.

It is accordingly an object of the present invention to provide a variety of game situations requiring different tactics through the use of a relatively simple arrangement of display and circuitry. It is a further object to permit simultaneous operation of the game by two operators and thereby tend to keep the interest of both of the operators. Furthermore, it is intended that these objects be achieved in a display layout and circuit arrangement that can easily be adapted to simulate different games.

SUMMARY OF THE INVENTION

The foregoing and related objects are achieved in a novel hand-held electronic game for simulating a sports-action game. The game includes a housing adapted to be held in a human hand and a display panel on the housing. The housing includes means simulating a multiplicity of stationary offensive players visible upon the outer surface of the display panel at predetermined stationary offensive-player positions. It also includes means simulating a stationary goal visible upon the outer surface of the display panel at a predetermined stationary goal position. At least one pass path of discrete electrically actuatable visual-image-producing devices is provided by the display panel between at least one pair of the simulated offensive players. The visual-image devices are operable by application thereto of electrical signals to provide images visible on the surface of the panel. At least one shot path of discrete electrically actuatable visual-image-producing devices is also provided between at least one of the offensive players and the goal, and these visual-image devices are also operable by application thereto of electrical signals to provide images visible on the surface of the display panel. Furthermore, the display panel has at least one defensive path of discrete visual-image-producing devices intersecting at least one of the shot and pass paths and operable by application thereto of electrical signals to provide images visible on the surface of the display panel.

The offensive player simulating means includes a discrete electrically actuatable offensive player visual-image-producing device disposed at the position of each one of the stationary simulated offensive players and operable by application thereto of electrical signals to provide an image visible on the surface of the display panel at the position of the simulated offensive player.

Status information means are mounted in the housing and operable by application thereto of electrical signals to display status information, and the housing contains operational-circuit means electrically connected to the visual-image-producing devices and the status-information means for generation and transmission of electrical signals thereto. The operational-circuit means include offensive simulation means for actuating one of the offensive player visual-image-producing devices at a time to simulate possession of a game object by one of the simulated stationary offensive players, means for consecutively actuating the visual-image-producing devices in a pass path beginning at the position of the most recently actuated offensive player visual-image-producing device to simulate a pass of the game object by the simulated player most recently in possession, and means for consecutively actuating the visual-image-producing device in a shot path beginning at the position of the most recently actuated offensive player visual-image-producing device towards the simulated goal. Defensive simulation means are included by the operational-circuit means for actuating various of the visual-image-producing devices of the defensive-player path to simulate the presence and movement of at least one defensive player in the defensive-player path. Coincidence-detection means are inclined for detecting the simulated coincidence of the simulated game object and the simulated defensive player and for affecting the operation of the offensive simulation means to simulate an incomplete pass upon coincidence of the defensive player and the game object during a simulated pass and to simulate an unsuccessful shot upon coincidence of the simulated defensive player and the game object during a simulated shot. The operational-circuit means also include means for monitoring play action to record information concerning the status of the simulated game and operable to produce signals indicative of the status information and apply those signals to the status-information means to display the status information.

Finally, the novel electronic game includes a multiplicity of manually operable control elements mounted in the housing and providing offensive and defensive control units. The manually operable control elements are electrically connected to the operational-circuit means for transmission of signals to it by operation of the control elements. The offensive simulation means simulates passes and shots in response to signals transmitted from the manually operable control elements of the offensive control unit, and the defensive simulation means simulates movement of the simulated defensive player in response to signals transmitted from the manually operable control elements of the defensive control unit.

The offensive simulation means retains the simulation of a game object coincident with the offensive player visual-image-producing device upon completion of a pass until further actuation of the offensive control unit of the manually operable offensive control elements. The control elements of the offensive unit are ineffective to move the stationary offensive player simulations but only effect movement of the game object therebetween and therefrom.

The means for simulating a stationary goal on the outer surface of the display panel can include an electrically actuatable goal-simulating visual-image-producing device operable by application thereto of electrical signals to produce a visual image at the predetermined stationary goal position on the outer surface of the display panel. The operational-circuit means would be electrically connected to the goal-simulating visual-image-producing device, and the offensive simulation means would include means for actuating the goal-simulating visual-image-producing device to simulate a successful shot. The means for simulating the stationary offensive players can include electrically actuatable offensive-player visual-image-producing devices operable by application thereto of electrical signals to provide images visible on the surface of the display panel at the predetermined offensive-player positions on the outer surface of the display panel. The operational-circuit means would be electrically connected to the offensive-player visual-image-producing devices, and the offensive simulation means would include means for actuating the offensive-player visual-image-producing devices to simulate possession of the game object by the offensive players. Additionally, the offensive-player simulation means can include permanently imprinted player symbols visible at the outer surface of the display panel at the predetermined stationary offensive-player positions.

It is advantageous to provide at least two shot paths, each shot path being between a different one of the offensive players and the goal. Simulated shots are thereby possible from more than one offensive-player position. At least two pass paths are also desirable, with at least one of the pass paths being free from intersection by the defensive path so that simulated coincidence of the simulated game object and the simulated defensive player in that pass path is precluded. In the preferred embodiments, the offensive-player simulating means simulates five offensive players. There are five pass paths, two of which are intersected by the defensive path and three of which are free from intersection by the defensive path.

In one version of the game the display panel includes a target path of discrete electrically actuatable visual-image-producing devices intersecting at least one of the shot paths and operable by application thereto of electrical signals to provide images visible on the outer surface of the display panel. The operational-circuit means is electrically connected to the visual-image-producing devices of the target path, and the defensive simulation means include means for actuating various of the visual-image-producing devices of the target path to simulate the presence and movement of a target along the target path. The coincidence-detection means includes means for detecting the simulated coincidence of the simulated game object and the simulated target and for affecting the operation of the offensive simulation means to simulate a successful shot upon coincidence of the simulated target and the simulated game object during a simulated shot. The offensive simulation means includes means for consecutively actuating the visual-image-producing devices in the shot path to simulate rebounds of the game object from the goal toward the offensive players, and the coincidence-detection means includes means for affecting the operation of the offensive simulation means to simulate a rebound only if the target and the game object fail to coincide during a simulated shot. The coincidence-detection means also includes means for affecting the operation of the offensive simulation means to simulate an offensively recovered rebound upon failure of the defensive player and the game object to coincide during a simulated rebound. The defensive simulation means in this version is operable to simulate movement of the simulated target independently of signals transmitted from the manually operable control elements of the offensive and defensive control units, and the target path intersects all of the shot paths in the preferred embodiment.

In another version of the game the display panel includes at least one goalie path of discrete electrically actuatable visual-image-producing devices operable by application thereto of electrical signals to provide images visible on the outer surface of the panel in a path that intersects at least one of the shot paths. The operational-circuit means is electrically connected to the visual-image-producing devices of the goalie path, and the defensive simulation means includes means for actuating various of the visual-image-producing devices of the goalie path to simulate the presence and movement of at least one goalie along the goalie path. The coincidence-detection means includes means for detecting the simulated coincidence of the simulated game object and the simulated goalie and for affecting the operation of the offensive simulation means to simulate an unsuccessful shot upon coincidence of the goalie and the game object during a simulated shot. The offensive simulation means includes means for consecutively actuating the visual-image-producing devices in the shot path to simulate rebounds of the game object from the goal toward the offensive players, and the coincidence-detection means affects the operation of the offensive simulation means to simulate a rebound upon coincidence of the goalie and the game object during a simulated shot. The coincidence-detection means also includes means for affecting the operation of the offensive simulation means to simulate an offensively recovered rebound upon failure of the defensive player and the game object to coincide during a simulated rebound. In the preferred embodiment, the manually operable control elements of the defensive control unit include first and second goalie control elements. The defensive simulation means simulates movement of the simulated goalie in a first direction in response to the first goalie control element and in a second direction in response to signals transmitted from the second goalie control element. Also in the preferred embodiment of this version, the goalie path intersects all of the shot paths.

Conveniently, the pass paths may provide an endless composite pass path through each of the offensive-player positions, one direction around the endless path being denominated the clockwise direction and the other being denominated the counterclockwise direction. One of the manually operable control elements of the offensive control unit would be a clockwise pass control element, and another would be a counterclockwise pass control element. The offensive simulation means would simulate clockwise passes in response to signals transmitted from the clockwise pass control element and counterclockwise passes in response to signals transmitted from the counterclockwise pass control element. The defensive path can have two ends, one a right end and the other a left end. The manually operable control elements of the defensive control unit would include right and left defensive-player control elements, and the defensive simulation means would simulate movement of the simulated defensive player toward the right and left ends in response to signals transmitted from the right and left defensive-player control elements, respectively.

Preferably, the defensive-simulation means includes means operable by operation of at least one of the manually operable control elements to defeat the response of the defensive simulation means to the manually operable elements of the defensive control unit and to simulate the presence and movement of the defensive player independently of signals from the manually operable control elements of the defensive control unit.

In either version of the game the monitoring means keeps score by adding points to a first total representing the score of a first team and adding points to a second total representing the score of a second team, alternately assigning offensive status to the first and second teams and adding points upon the occurrence of successful shots to the first team when it is on offense and to the second team when it is on offense. The monitoring means can maintain a countdown that begins at a predetermined number at the beginning of each play and is decremented at a predetermined rate until a successful shot occurs. The monitoring means would affect the offensive and defensive simulation means to terminate the current play, and it would change the status of each team when the countdown reaches zero.

BRIEF DESCRIPTION OF THE DRAWINGS

These and other features of the present invention are described with reference to the attached drawings, in which.

DETAILED DESCRIPTION OF THE PREFERRED EMBODIMENTS

Figure 1:
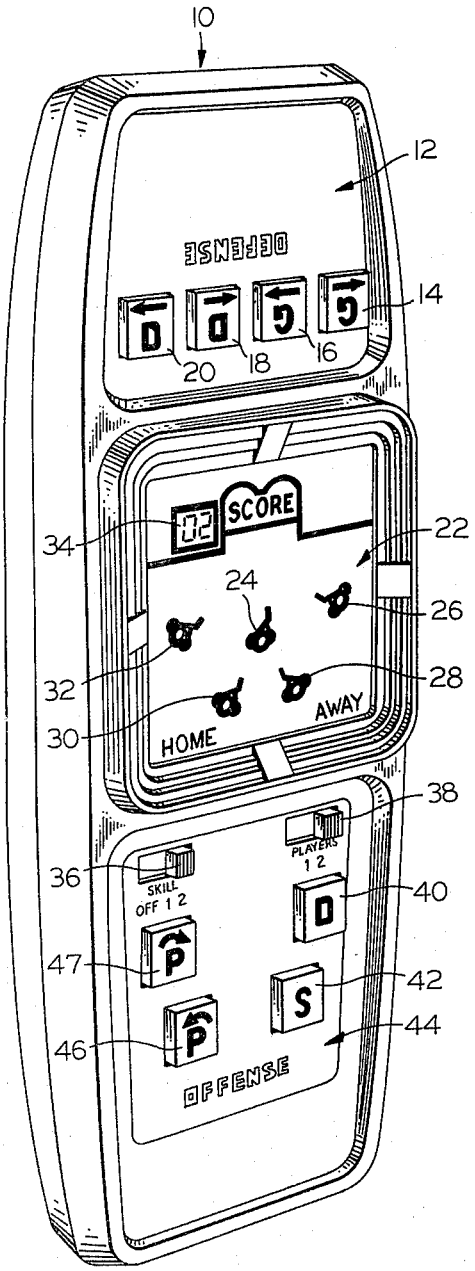
FIG. 1 is a perspective view of one version of the present invention in which the game of hockey is simulated.

FIG. 1 illustrates in perspective one embodiment of the present invention. It is a hand-held device for simulating the game of hockey, although with slightly different graphics a soccer game can be simulated. The game device of FIG. 1 includes a housing, indicated generally by reference numeral 10, on which is mounted a display surface 22 flanked by control boards 12 and 44. Control board 12 controls defensive movement, and control board 44 controls offensive movement. The display panel 22 has five player symbols 24, 26, 28, 30, and 32 imprinted on it to simulate five stationary offensive players. Commands from the offensive control board 44 direct the simulated movement of a hockey puck between the simulated offensive players. A status display 34 is also mounted in the housing to display various types of status information such as the score, the amount of time left in the game, and the amount of time in which to score.

The offensive control board includes two pass buttons 46 and 47 that are employed as will be described in more detail below to direct simulated passes between pairs of stationary players. Shots at the goal are ordered by operation of a shot button 42. A display button 40 is used for various purposes, such as causing status information to be displayed.

A power/skill switch 36 is also provided on the offensive control board. It is a three-position switch that both turns the game on and off and determines what level of skill will be required to play the game. Finally, the offensive control board has a player switch 38 that determines whether the device will be operated by only one person at a time or by two people simultaneously. In the "1" position of switch 38 only offensive control board 46 is activated, while defensive control board 12 is operable when player switch 38 is in the "2" position.

The defensive control board has four buttons 14, 16, 18, and 20. Buttons 14 and 16 provide control of a simulated goalie, and buttons 18 and 20 control the activity of the other defensive player.

Figure 2:
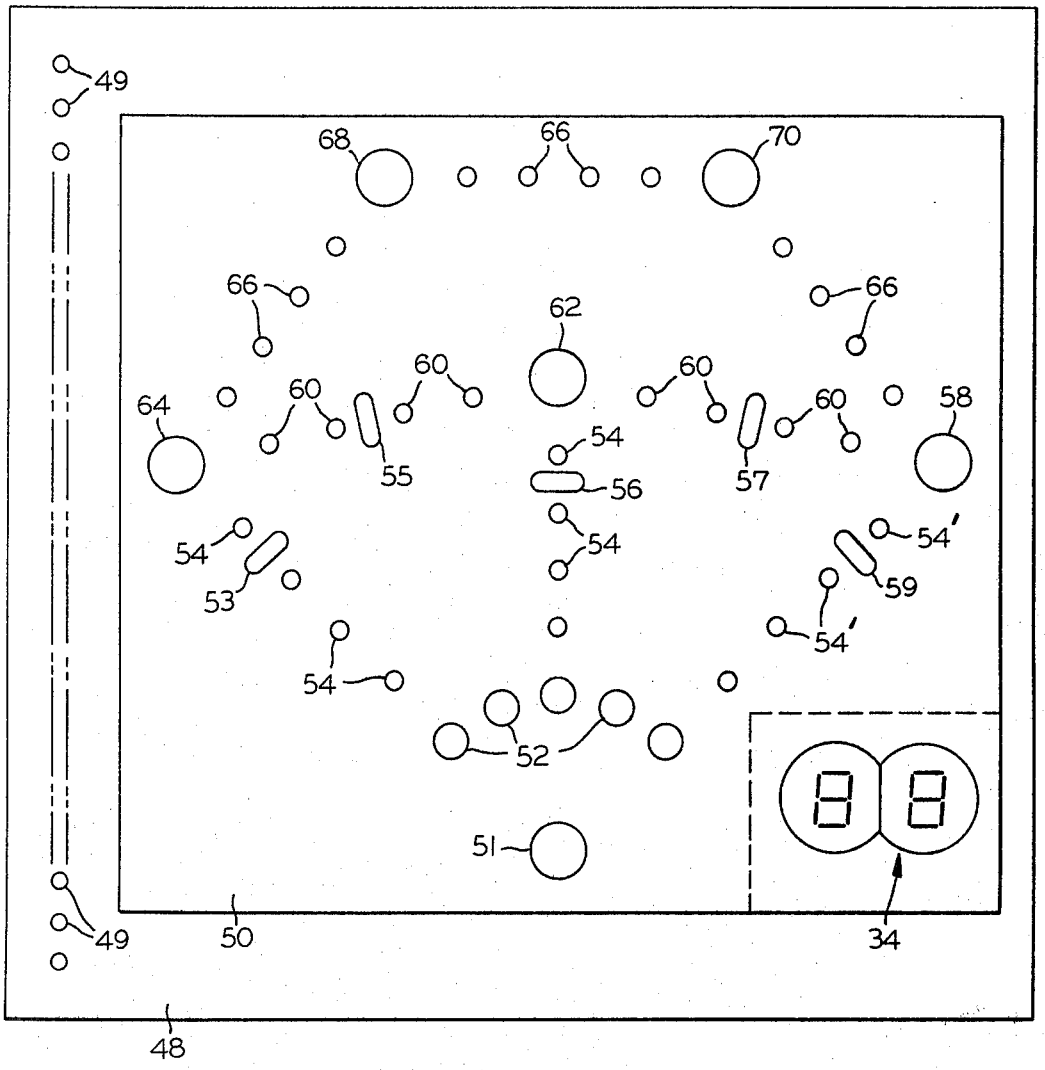
FIG. 2 is a plan view of the display panel and status display mounted on a printed-circuit board.
Figure 3:
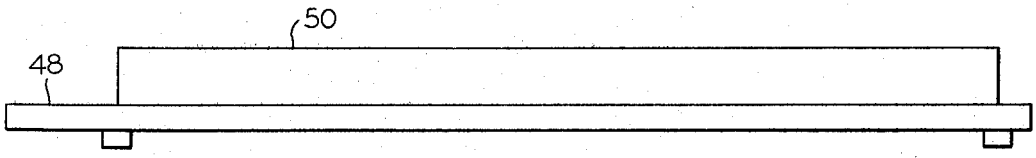
FIG. 3 is a vertical elevation of the displays and printed-circuit board shown in FIG. 2.

The display panel is shown in more detail in FIGS. 2 and 3, in which it is shown that a display surface 50 is mounted on a circuit board 48 having contacts 49 to which signals are applied. The display surface has openings in it that are aligned with light-emitting diodes on the circuit board. The LEDs are actuatable by application of signals to terminals 49. The openings are disposed high enough above the light-emitting diodes that the shapes of the light images produced by the diodes are determined predominately by the shapes of the associated openings in the displays surface. Of course, images may be produced by apparatus other than the LED-and-hole combination illustrated; any type of discrete electrical or electronic device for producing a visual image can be employed. For example, liquid-crystal devices, incandescent bulbs, and LEDs with lenses can also be employed to carry out the teachings of the present invention.

Round openings 58, 62, 64, 68, and 70 register with the graphic symbols 32, 24, 26, 28, and 30, respectively, that represent stationary offensive players. The illumination of an opening beneath an offensive player symbol represents possession of the puck by the offensive player. A further round opening 51 of approximately the same size as that of the offensive-player openings represents the goal into which it is the object of the game to shoot the puck, and the goal lights up upon the occurrence of a successful shot. A shot at the goal is simulated by consecutively lighting LEDs under openings 54. For instance, with offensive-player opening 64 lighted initially, successive openings 54 between opening 64 and the opening 52 farthest to the left would light to simulate a shot, and if a successful shot were to be indicated, opening 51 would light.

In addition to shot paths made up of openings 54, there are also pass paths made up of openings 60 and 66. A pass between the offensive players simulated by openings 58 and 62 would be simulated by the extinguishment of the LED beneath opening 58, the consecutive illumination of openings 60, and finally the illumination of opening 62, representing possession of the puck by the player symbol aligned with opening 62.

Defensive play is simulated through illumination of openings 52, 53, 55, 56, 57, and 59. Round openings 52 are lighted one at a time to show the presence of a goalie, while oblong openings 53, 55, 56, 57, and 59 are lighted one at a time to represent the presence of another defensive player. As is apparent from the drawing, each of the oblong openings is in either a pass path or a shot path, although it would not be necessary in general for all defensive players to be so situated in order to follow the teachings of the present invention. As will be described in more detail below, the presence of a defensive player in a path, as indicated by a lighted oblong opening in that path, prevents completion of a pass or the success of a shot along the path occupied by the simulated player. Unlike the oblong defenseman openings, the goalie openings 52 only intersect the shot paths. This, of course, simulates the normal function of a goalie.

Figure 4:
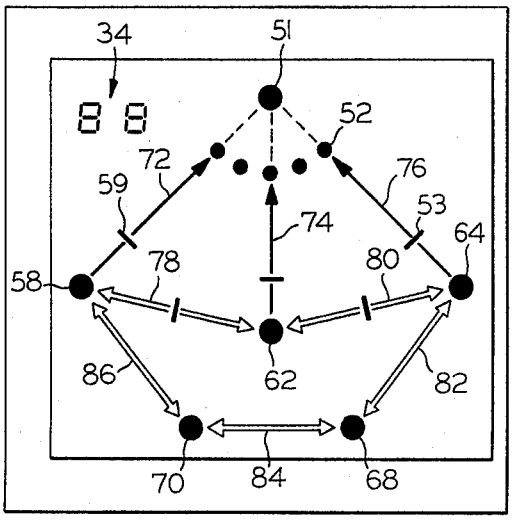
FIG. 4 is a diagrammatic representation of the display panel illustrating the possible offensive movements.

The offensive movements open to the operator of offensive control board 46 will now be explained in more detail by reference to FIG. 4. The objective of the offensive operator, of course, is to shoot the puck successfully at the goal. The puck is passed among the offensive players until it appears that a shot at the goal will be successful, and then shot button 42 is depressed. Possession of the puck by one of the offensive players is indicated by the illumination of one of the openings 58, 62, 64, 68, or 70, and a shot occurs only if shot button 42 is depressed while a player is in possession. Furthermore, the puck can be shot only by the players associated with openings 58, 62, and 64. The other two players can only pass. A shot path 72 of LEDs simulates a shot at the goal from the player at the position of opening 58. Similarly, shots from the players at the positions of openings 62 and 54 are simulated by consecutive illuminations of LEDs along shot paths 74 and 76, respectively.

In addition to shooting, the offensive operator can pass by pressing pass button 46 or 47. Buttons 47 and 46 represent clockwise and counterclockwise passes, respectively. The clockwise direction is defined by the following order of openings: 58, 62, 64, 68, 70, 58. The counterclockwise direction is just the reverse. Accordingly, if opening 62 is illuminated, indicating possession of the puck by the associated simultated player, operation of clockwise pass button 47 will cause the simulation of a pass to the simulated player associated with opening 64. If counterclockwise button 46 is depressed, on the other hand, a pass to the player associated with opening 58 will be simulated. The pass buttons must be released and depressed again each time it is desired to pass. Operation of buttons 46 and 47 enables the offensive operator to maneuver the puck into an advantageous position for shooting.

Figure 5:
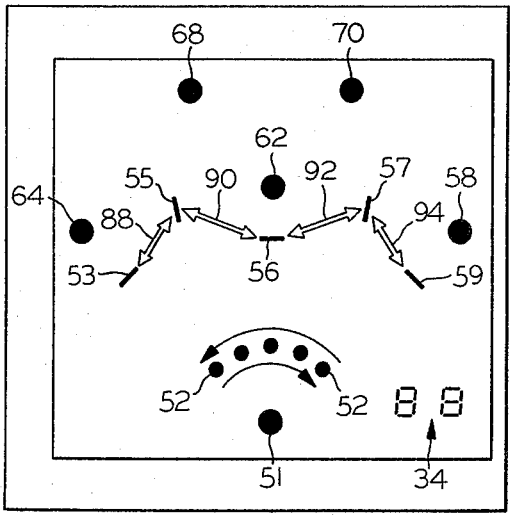
FIG. 5 is a similar representation showing the possible defensive movements.

The purpose of maneuvering the puck between offensive players prior to shooting is to avoid the defensive players, whose possible movements are illustrated in FIG. 5. When player switch 38 is in the position that indicates the two-player mode, control of the defensive players is afforded through operation of the buttons on the player switch 38 is in the position indicating the one-player mode, the control of the defensive players is provided by the circuitry of the game itself.

Arrows 88, 90, 92, and 94 of FIG. 5 indicate the possible moves of one of the defensive players. (The other defensive player is the goalie.) From the position of opening 53 the defensive player has one possible simulated move, as indicated by arrow 88, to the position of opening 55. From opening 55, the possible moves are either to opening 53 or 56, as is indicated by arrows 88 and 90. In other words, whenever one of the openings 53, 55, 56, 57, or 59 is lighted, an adjacent defensive-player opening will be the next to be illuminated once the diode under the currently illuminated opening is extinguished.

The simulation of goalie movement in the two-player mode is the same as the simulation of the movement of the other defensive players. In the one-player mode, however, the goalie positions 52 that are not in the shot paths are sometimes skipped, so illumination of the goalie opening 52 in shot path 72 may be followed by illumination of the goalie opening in shot path 74 rather than of the intervening goalie opening.

Positioning of the defensive player and the goalie is effected by operation of buttons 14, 16, 18, and 20 on the defensive control board. Simulation of movement of the defensive player to the right is caused by operation of button 20. If opening 53, say, is illuminated initially, operation of button 20 will result in the diode under opening 53 being de-energized, and openings 55, 56, 57, and 59 will be illuminated in succession if button 20 remains depressed. Opening 59 will thereafter remain illuminated until button 18 is depressed to cause movement in the other direction. If button 20 is released during or before illumination of one of the intermediate defensive-player openings, that opening will remain illuminated until there is a further operation of button 18 or 20. Thus, actuation of the defensive player differs from the activation of passes and shots in that successive moves of the defensive player in a single direction do not require individual operations of the buttons for each move, while each pass requires another button operation.

Operation of the goalie by "G" buttons 14 and 16 is the same as the operation of the other defensive player by "D" buttons 18 and 20.

In the preferred embodiment provision is also made, as was indicated previously, for one-player operation, in which the game circuitry controls the movement of the defensive players. The goalie is sequenced automatically from left to right or right to left, depending on which side of the field the puck is on. If the puck enters into possession of the simulated player at the position of opening 58 or 70, the goalie will move from the left goalie opening to the right goalie opening and remain there as long as the puck is on the right side of the field (from the defensive point of view.) If the puck is subsequently moved to the position of opening 64 or 68, movement of the goalie will be simulated from right to left until the goalie takes up a position at the left goalie opening. It will then stay in this position until the puck is no longer at the position of opening 64 or 68. If opening 62 is illuminated, simulating the possession of the puck by the player at the position of opening 62, the goalie sequences back and forth continuously.

As briefly mentioned before, the goalie sometimes skips positions when in the one-player mode. This is the result of random selection of one of two operating sequences. In the first sequence, simulation of motion is by consecutive illumination of adjacent openings, while the second sequence leaves out the two goalie openings that are not on shot paths. The sequence selection is random, but the second sequence is selected more frequently when power/skill switch 36 indicates Skill 1 than when it indicates Skill 2.

The other defensive player moves between its various positions in a psuedo-random manner in the one-player mode, its positions being random both in order and in time but weighted toward center position 56.

To play the game in the two-player mode, three-position switch 36 is moved from the OFF position to one of the two skill positions, and switch 42 is moved to the two-player position. The game is thereby turned on and the defensive control board activated. The game is divided into three periods of twenty simulated periods each. The home team is on offense at the beginning of the first period, and possession changes sides at the beginnings of the second and third periods. The game is started and the internal circuitry that keeps track of the time begins its countdown when one of the "P" buttons 46 and 47 is held down while "D" button 40 is simultaneously depressed. At the beginning of the first play, rear opening 70 is illuminated, indicating the possession of the puck by the simulated player at that position. A pass is then simulated in the direction indicated by the "P" button that was depressed. This first pass will be completed because there is no defensive player between opening 70 and either of the openings to which a pass is possible. Therefore, all of the openings in the pass path are illuminated in succession, thereby indicating a completion. Completion is also indicated by the illumination of opening 58 or 68, whichever is the opening associated with the intended receiver.

If the intended receiver position is that of opening 58, the offensive operator can attempt a shot at the goal as soon as opening 58 has been illuminated. As was indicated before, the shot is attempted by depressing shot button 42, which causes a shot to be simulated in the manner previously described. Assuming that a shot is made from position 58, simulation of a shot begins by illumination of the first opening in path 76. If no defensive player is in position 59 as the puck passes that position, the puck continues toward the goal. If the puck encounters no interference from the goalie, goal opening 50 is illuminated, the internal circuitry awards a point to the home team, and a turnover occurs. On the other hand, if the defensive player is in position 59 as the puck passes that position, shot simulation is interrupted to indicate an interception, and a turnover occurs with no award of a point. No turnover occurs if the puck coincides with the goalie; instead, the puck is rebounded along path 76 toward opening 64.

When a turnover occurs, the display blank out. At this time display key 40 can be depressed to cause seven-segment displays 34 to give the score. An "H" is first displayed to indicate the home team, the home-team score is then displayed, display of an "A" follows to indicate the away team, and the away-team score is then given. A second depression of the display key causes the time remaining in the game to be displayed.

The operators switch control boards when a turnover occurs, and play is restarted by holding one of the "P" buttons down and depressing display button 40. If the visiting team is now on offense, opening 68 is illuminated initially, and play occurs as before. During play action the seven-segment displays 34 serve as a countdown clock to indicate the amount of time the offense has to score. In Skill 1 the countdown starts at twenty-four simulated seconds, while only twelve simulated seconds are allowed in Skill 2. The countdown clock is reset at the beginning of play after each turnover and counts down until an interception or score. If the countdown clock runs down to zero, a turnover automatically occurs.

Interception of the puck can occur not only during passes and shots but also during rebounds. If a shot from the player at opening 58 toward goal opening 50 coincides with the goalie in shot path 72, a rebound is simulated by consecutive illumination of openings along shot path 76 in the direction from opening 50 toward opening 64. If the rebounding puck thereby simulated coincides with the defensive player at opening 53, a turnover will occur just as it would if the interception had occurred during a shot or pass. A shot from position 58 rebounds toward position 64, while a shot from position 64 rebounds toward position 58. A rebound toward position 62 will occur if the shot is made from that position. If an interception does not occur, the offensive-player opening at the end of the shot path will indicate possession of the puck at the end of rebound simulation, and the team that made the shot will remain in possession. Since the same play is continuing, the countdown clock is not reset, so the team in possession gains no extra time to score by attempting a shot.

Play continues in the manner thus far described until the end of the period. Play then continues as it does after any turnover until the end of the second period, and the game ends at the end of the third period, when the score is displayed automatically without the depression of display key 40. At this point, the device ignores further attempts to play the game until power/skill 36 switch is operated to the OFF position and then back to Skill 1 or Skill 2.

In the preferred embodiment, the device for playing the game produces sound effects by applying signals to a piezoelectric transducer contained inside the housing. Beeps are produced whenever there is ball movement, and a buzz occurs to indicate a turnover. When a shot is successfully made, a song is played by the device. Appropriate sound effects are produced at the end of a period and on the occurrence of a rebound, and ticks are heard as the countdown clock runs.

With the differences in operation of the goalie and defensive player noted previously, the one-player game is essentially the same as the two-player game. Since only the offensive operator operates the device, though, one operator hands the device to the other when a turnover occurs.

It is among the particular advantages of the device described thus far that essentially the same display panel and general arrangement can be used to simulate several different games. With a slight change in graphics, the same circuitry and layout can be employed to simulate the game of soccer. The same general layout with different graphics can also be used to simulate the game of basketball, although in the preferred embodiment of the basketball version, some differences in the controlling microprocessor chip have been made to provide a more realistic simulation.

Figure 6:
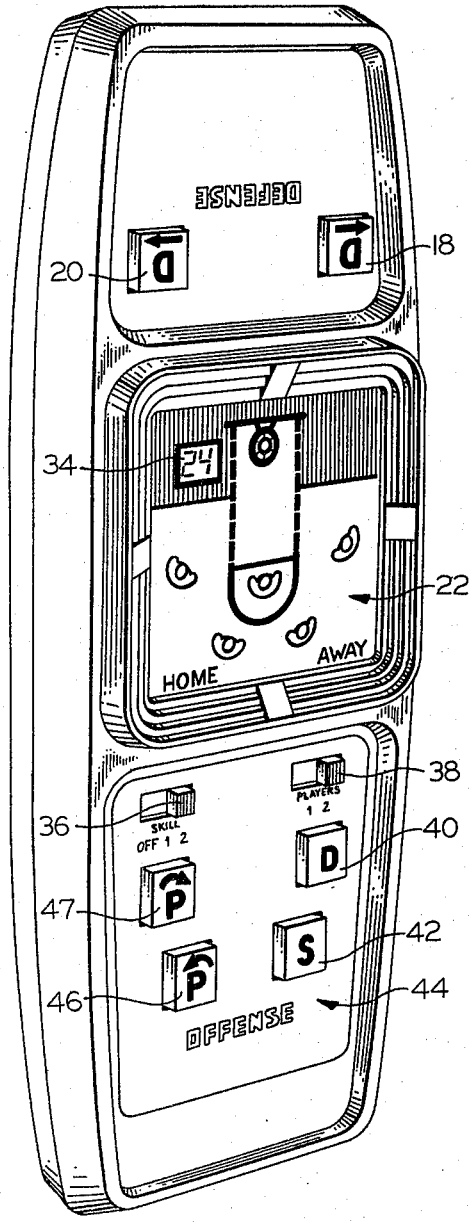
FIG. 6 is a perspective view of a device representing another version of the present invention, this one for simulating the game of basketball.

FIG. 6 is a perspective view of the preferred embodiment of a basketball version of the present invention. It is apparent that the graphics on the display panel are somewhat different, and only two defensive buttons are provided because no goalie is controlled by the operator. The display panel is basically the same, however, as is most of the wiring. The programming of the microprocessor is somewhat different from that of the hockey/soccer version so that it will effectuate the functions described below.

As in the hockey/soccer version, there are five stationary offensive-player positions and a stationary goal position on the display panel. There are also shot paths and pass paths as in the hockey/soccer version with a path for a defensive player intersecting those paths. Accordingly, reference can be made to FIGS. 2, 3, 4, and 5 for explanation of the functioning of the basketball version of the game.

Probably the biggest difference between the basketball version and the hockey version is that openings 52 do not simulate a goalie; they simulate a target or window through which the offensive player must shoot the ball in order to "reach" goal opening 50. If the ball coincides with an opening 52 while it is illuminated, a successful shot is simulated and two points are awarded the offensive side. In other words, the operator attempts to hit the illuminated opening 52, not avoid it.

Game action is begun in the same manner as in the hockey/soccer version, with the ball in the possession of the offensive player at position 68 or 70. In contrast to the hockey/soccer version, however, a shot can be made from position 68 or 70. If the shot button 42 is depressed while opening 68 is illuminated, sequential illumination of openings on paths 82 and 76 will simulate a shot at the goal. Of course, since the players at positions 68 and 70 are twice as far away from the goal as those at positions 58, 62, and 64, the timing is somewhat more difficult, so the operator will often prefer to pass to one of the more forward positions before attempting a shot.

Other than the addition of two positions from which to shoot, passing and shooting in the basketball version are the same as in the hockey/soccer version. Rebounds also occur in the same directions as in the hockey/soccer version, but in the basketball version the rebound occurs when there is not coincidence of the light in the shot path with the light in opening 52, and the position of the target, unlike the position of the goalie, is not controlled by the defensive operator in two-player play.

In the basketball version, the game is divided into four quarters of fifteen simulated minutes each. As in the hockey/soccer version, the home team is on offense at the beginning of the first period, and a turnover occurs at the beginning of each succeeding period. In the two-player version of the basketball game, there is only one operable skill position, so the player on offense always has 24 seconds in which to shoot. Sound effects similar to those in the hockey/soccer version are produced for the basketball version, and the score and timing remaining are also displayed in a similar manner. As noted before, two points, rather than one point, is awarded for a successful shot.

The one-player mode of the basketball version illustrates several possible variations of the device. Both skill positions are operable in this mode, and the target moves back and forth automatically at three different speeds in Skill 1. The target will move at Speed 1, the lowest speed, for the first six seconds and then change to Speed 2, the next higher speed. After another eight seconds the target moves at Speed 3, which is higher than either of the first two speeds. As in the one-player hockey game, the other defensive man also moves automatically in a random fashion, although in the basketball game the random motion is keyed to the position of the ball. Like the target, the defensive player also moves at various speeds that increase as the play progresses. The defensive player begins at Speed 1 and remains at Speed 1 as the target advances to Speed 2. When the target advances to Speed 3, the defensive player advances to Speed 2 and remains at that speed.

When power/skill switch 36 is in the Skill 2 position, both the defender and the target begin at Speed 1 but increase in speed after one second, the defender advancing to Speed 2 and the target jumping to Speed 3. Nine seconds later, the target advances to Speed 4 and the defender to Speed 3.

With the exception of the above-noted differences, the basketball version is quite similar to the hockey/soccer version, and those skilled in the art will appreciate that a large portion of the manufacture of both games is the same. This, of course, contributes to ease of manufacture, since essentially the same display panel and wiring are used in all versions.

Figure 7:
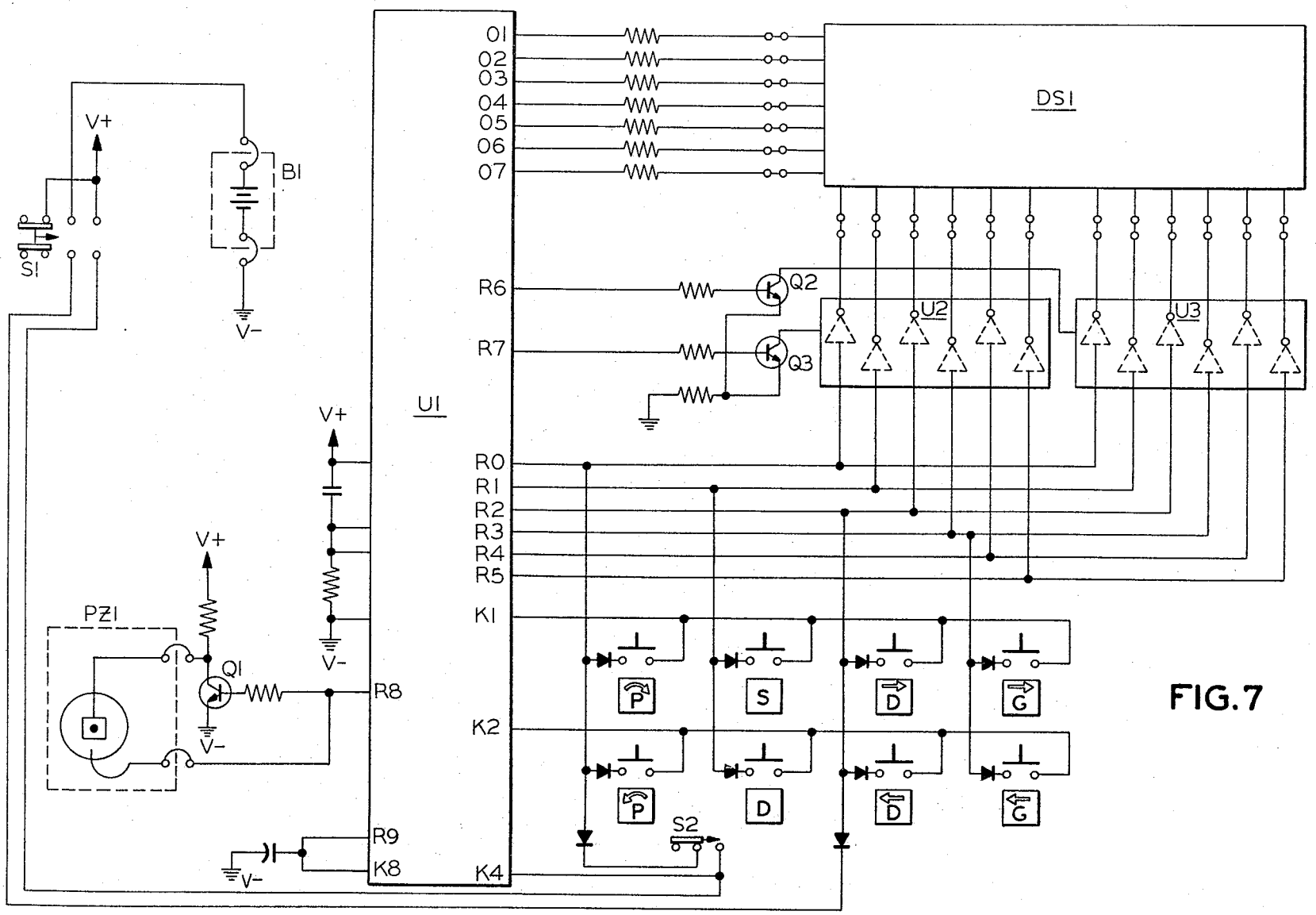
FIG. 7 is a schematic diagram showing the interconnections between the microprocessor that controls the device and the various input and output devices.
Figure 8:
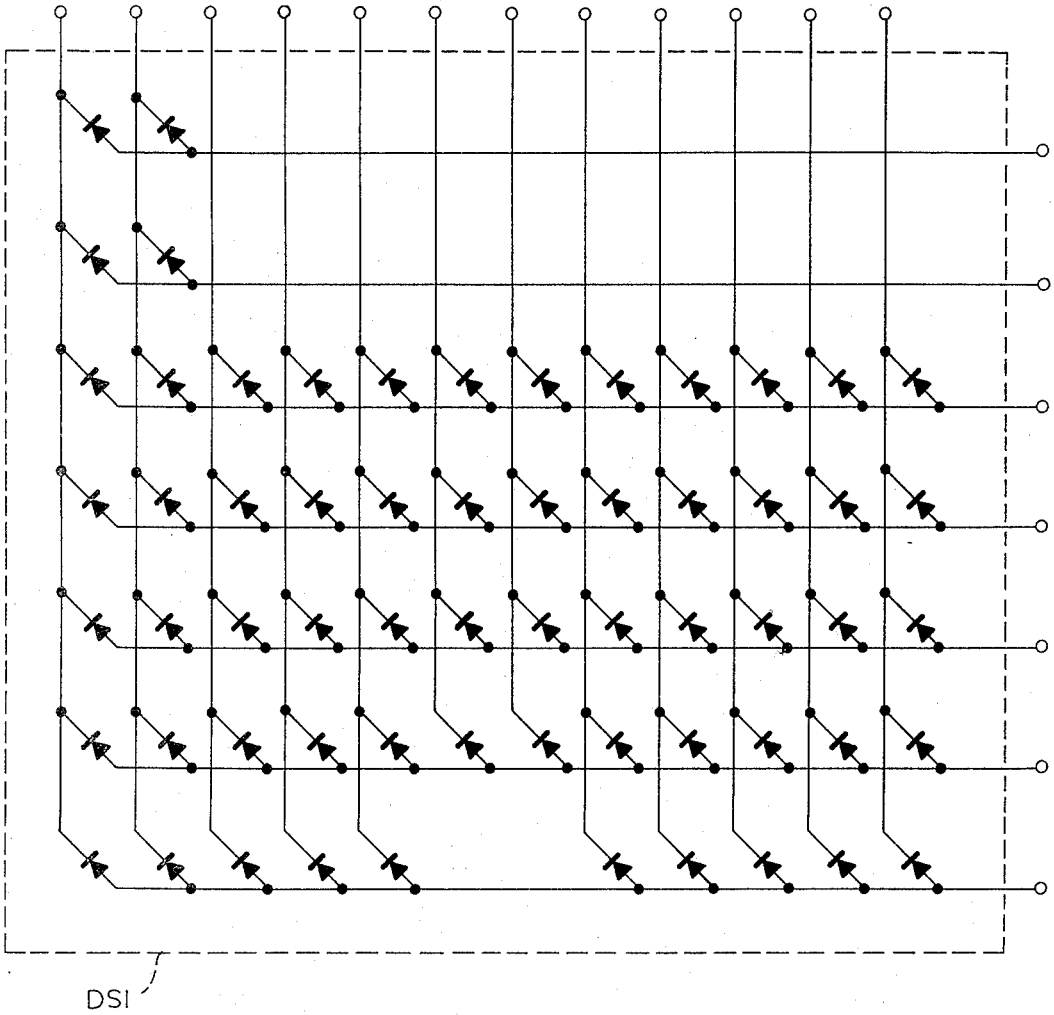
FIG. 8 is a schematic diagram of the diode matrix represented by block DS1 of FIG. 7.
Figure 9:
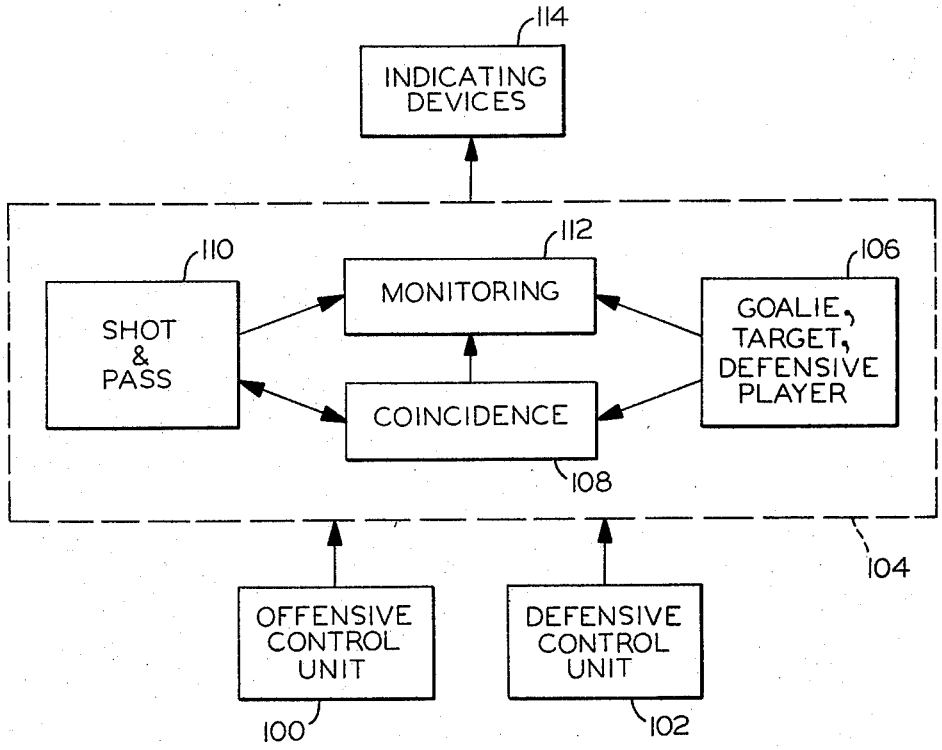
FIG. 9 is a block-diagram representation of the various functions, inputs, and outputs of the operational circuit of the present invention.

The preceding functions are realized by the circuitry shown in FIGS. 7, 8, and 9. FIG. 7 is a schematic of the various chip connections, and FIG. 8 is a schematic of chip DS1. The circuitry will not be described in detail here because the functions are predominently determined by mask programming of microprocessor U1. Such a description would be excessively involved and of questionable utility because the functions described here could be realized on a wide variety microprocessor types with quite varied programs. However, a conceptual portrayal of the functions is provided in FIG. 9.

Microprocessor U1 of FIG. 7 is programmed, in a manner that will be apparent to those skilled in the art, to provide the several functions indicated diagrammatically in FIG. 9. The microprocessor and related operational circuitry are represented in FIG. 9 by dashed lines 104. Inputs to the device are provided by the several buttons described previously, the buttons providing an offensive control unit 100 and a defensive control unit 102. (For simplicity, the power/skill, player-number, and display buttons are unrepresented in FIG. 9.) Offensive control unit 100 would, of course, include the two pass buttons and the shot button, while the defensive control unit would include the two directional "D" buttons in both versions and the two directional "G" buttons in the hockey/soccer version. These control units transmit directions to the microprocessor, which controls puck or ball movement, as indicated by shot-and-pass block 110, and defensive-player movement, as indicated by block 106.

The various versions of the game all require that detection of coincidence between the defensive player and the ball or puck be detected, and this function is represented by block 108 in FIG. 9 and the arrows leading from blocks 106 and 110 to block 108. One arrow is double-headed to show that detection of coincidence has an effect on the simulation of the puck or ball. Also common to all the games is the fact that the operational circuit that includes the miroprocessor must monitor the play action to keep track of such things as the score, the time remaining, the team on offense, and so forth. This is indicated by block 112.

The results of the various actions of operational circuit 104 are displayed by the various indicating devices 114. According to the present invention, one of the devices is a display panel of the type whose layout was described previously. Block 114 also represents a status-information means, the exemplary version being the seven-segment displays 34 of the preferred embodiments. Although it is not essential, piezoelectric transducer PZ1 in FIG. 7, which signals various occurrences in the game by appropriate sound effects, is another example of an indicating device that can be controlled by the operational circuit.

The connections to the various input and output terminals of the microprocessor will be described only in a general fashion because those skilled in the art will understand the arrangement without an elaborate exposition of the function of each signal line. Power is applied to the microprocessor by a battery B1, which is connected to the V+ terminals upon actuation of switch S1. S1 is the schematic representation of three-position switch 36 of FIG. 1. Inputs to the circuitry of U1 are produced by operation of the various buttons seen in FIGS. 1 and 6 and similarly represented in FIG. 7. The schematic of the FIG. 6 version is the same as that shown in FIG. 7 with the exception that the two "G" buttons are not provided.

A piezoelectric transducer that provides the various sound effects that the game employs is controlled from a single terminal R8 of V1. This terminal drives one side of the piezoelectric transducer PZ1 and also drives the input of an inverting amplifier that includes Q1. Oscillatory signals at terminal R8 thereby cause oscillation at the terminals of piezoelectric transducer PZ1 and thus produce the sound effects desired.

The block labeled DS1 represents the diodes that are arranged under the openings shown in FIG. 2. The LEDs are wired in a matrix arrangement, as can be seen in FIG. 8, the horizontal and vertical lines in FIG. 8 representing the horizontal and vertical lines, respectively, leaving DS1 in FIG. 7. As can be appreciated from a perusal of FIG. 8, a single diode is specified by the combination of one horizontal line with one vertical line. Microprocessor U1 multiplexes the display by rapidly sequencing through various combinations of the lines. Several of the diodes are connected by their anodes to terminal O1 of microprocessor U1 through a current-limiting resistor. Each of the diodes thus connected to terminal O1 are connected by its cathode to a different one of the outputs of amplifier chips U2 and U3. Thus, by applying a relatively positive signal at terminal O1 and a relatively negative signal at the appropriate output terminal of U2 or U3, it is possible to illuminate a specific LED. Conversely, a number of diodes are connected by their cathodes to the amplifier in chip U2 that is controlled by terminal R0 of microprocessor U1. To select a specific one of these diodes for illumination, it is necessary simultaneously to apply the appropriate signal at R0 and at the appropriate one of the terminals O1 through O7.

It is apparent from this description that it is not possible for some combinations of diodes to be illuminated simultaneously if the remainder are to be kept extinguished. Accordingly, the microprocessor applies signals to lines O1 through O7 in succession, and in general different combinations of the terminals R0 through R5 have the appropriate signals on them. Furthermore, as a study of the circuit indicates, the two chips U2 and U3 are themselves multiplexed by alternate driving of current amplifiers Q2 and Q3 from terminals R6 and R7, respectively. Of course, the multiplexing is fast enough that illumination of the various diodes appears to be simultaneous.

In summary of FIGS. 7, 8, and 9, the microprocessor receives power and input signals through the various switches. Under the control of programs contained in it, it transmits signals to DS1, which includes both the display panel and the seven-segment status displays. It also sends signals to piezoelectric transducer PZ1 to provide the desired sound effects.

From the foregoing description it can be appreciated that very engaging simulations of different games can be realized through the use of a display panel having the advantageous features described above. Simplicity of design and manufacture and low cost are afforded by an organization in which a limited number of discrete light-image-producing devices are arranged in paths among stationary goal and offensive-player positions. Despite their simplicity of arrangement, games arranged according to the teachings of the present invention both enable two players to control the device simultaneously and provide a wide variety of play situations that serve to maintain the interest of both operators.

Having thus described the invention, I claim:

1. A hand-held electronic game for simulating a sports-action game comprising:

A. a housing adapted to be held in a human hand;

B. a display panel on said housing and including:

(i) means simulating a multiplicity of stationary offensive players visible upon the outer surface of said display panel at predetermined stationary offensive-player positions thereon;

(ii) means simulating a stationary goal visible upon the outer surface of said display panel at a predetermined stationary goal position thereon;

(iii) at least one pass path of discrete electrically actuatable visual-image-producing devices between at least one pair of said simulated offensive players and operable by application thereto of electrical signals to provide images visible on said surface of said panel;

(iv) at least one shot path of discrete electrically actuatable visual-image-producing devices between at least one of said offensive players and said goal and operable by application thereto of electrical signals to provide images visible on said surface of said display panel; and (v) at least one defensive path of discrete visual-image-producing devices intersecting at least one of said shot and pass paths and operable by application thereto of electrical signals to provide images visible on said surface of said display panel, said offensive player simulating means including a discrete electrically actuatable offensive player visual-image-producing device disposed at the position of each one of said stationary simulated offensive players and operable by application thereto of electrical signals to provide an image visible on said surface of said display panel at the position of said simulated offensive player;

C. status information means mounted in said housing and operable by application thereto of electrical signals to display status information;

D. operational-circuit means contained in said housing, electrically connected to said visual-image-producing devices and said status-information means for generation and transmission of electrical signals thereto and including:

(i) offensive simulation means including means for actuating one of said offensive player visual-image-producing devices at a time to simulate possession of a game object by one of said simulated stationary offensive players, means for consecutively actuating said visual-image-producing devices in a pass path beginning at the position of the most recently actuated offensive player visual-image-producing device to simulate a pass of the game object by said simulated player most recently in possession, and means for consecutively actuating said visual-image-producing devices in a shot path beginning at the position of the most recently actuated offensive player visual-image-producing device towards said simulated goal;

(ii) defensive simulation means for actuating various of said visual-image-producing devices of said defensive-player path to simulate the presence and movement of at least one defensive player along said defensive-player path;

(iii) coincidence-detection means for detecting the simulated coincidence of said simulated game object and said simulated defensive player and for affecting the operation of said offensive simulation means to simulate an incomplete pass upon coincidence of said defensive player and said game object during a simulated pass and to simulate an unsuccessful shot upon coincidence of said simulated defensive player and said game object during a simulated shot;

(iv) means for monitoring play action to record information concerning the status of the simulated game and operable to produce signals indicative of said status information and apply said signals to said status-information means to display said status information; and E. a multiplicity of manually operable control elements mounted in said housing and providing offensive and defensive control units, said manually operable control elements being electrically connected to said operational-circuit means for transmission of signals to said operational-circuit means by operation of said control elements, said offfensive simulation means simulating passes and shots in response to signals transmitted from said manually operable control elements of said offensive control unit, and said defensive simulation means simulating movement of said simulated defensive player in response to signals transmitted from said manually operable control elements of said defensive control unit, said offensive simulation means retaining the simulation of a game object coincident with the offensive player visual-image-producing device upon completion of a pass until further actuation of said offensive control unit of said manually operable offensive control elements, said control elements of said offensive unit being ineffective to move said stationary offensive player simulations but effecting movement of the game object therebetween and therefrom.

2. The hand-held electronic game of claim 1 wherein said means for simulating a stationary goal on said outer surface of said display panel includes an electrically actuatable goal-simulating visual-image-producing device operable by application thereto of electrical signals to produce a visual image at said predetermined stationary goal position on said outer surface of said display panel, said operational-circuit means is electrically connected to said goal-simulating visual-image-producing device, and said offensive simulation means includes means for actuating said goal-simulating visual-image-producing device to simulate a successful shot.

3. The hand-held electronic game of claim 1 wherein said means for simulating said stationary offensive players includes electrically actuatable offensive-player visual-image-producing devices operable by application thereto of electrical signals to provide images visible on said surface of said display panel at said predetermined offensive-player positions on said outer surface of said display panel, said operational-circuit means is electrically connected to said offensive-player visual-image-producing devices, and said offensive simulation means includes means for actuating said offensive-player visual-image-producing devices to simulate possession of said game object by the offensive players.

4. The hand-held electronic game of claim 1, 2, or 3 wherein said offensive-player simulation means further includes permanently imprinted player symbols visible at the outer surface of said display panel at said predetermined stationary offensive-player positions.

5. The hand-held electronic game of claim 1 in which there are at least two shot paths, each shot path being between a different one of said offensive players and said goal, simulated shots thereby being possible from more than one offensive-player position.

6. The hand-held electronic game of claim 5 wherein said display panel includes at least two of said pass paths, at least one of said pass paths being free from intersection by said defensive path, thereby precluding simulated coincidence of said simulated game object and said simulated defensive player in said last-mentioned pass path.

7. The hand-held electronic game of claim 6 wherein said offensive-player simulating means simulates five offensive players, there being five pass paths, two of which are intersected by said defensive path and three of which are free from intersection by said defensive path.

8. The hand-held electronic game of claim 1 wherein said display panel includes a target path of discrete electrically actuatable visual-image-producing devices intersecting at least one of said shot paths and operable by application thereto of electrical signals to provide images visible on said outer surface of said display panel, said operation-circuit means being electrically connected to said visual-image-producing devices of said target path, said defensive simulation means including means for actuating various of said visual-image-producing devices of said target path to simulate the presence and movement of a target along said target path.

9. The hand-held game of claim 8 wherein said coincidence-detection means includes means for detecting the simulated coincidence of said simulated game object and said simulated target and for affecting the operation of said offensive simulation means to simulate a successful shot upon coincidence of said simulated target and said simulated game object during a simulated shot.

10. The hand-held electronic game of claim 9 wherein said offensive simulation means includes means for consecutively actuating said visual-image-producing devices in said shot path to simulate rebounds of said game object from said goal toward said offensive players, and wherein said coincidence-detection means includes means for affecting the operation of said offensive simulation means to simulate a rebound only if said target and said game object fail to coincide during a simulated shot.

11. The hand-held electronic game of claim 10 wherein said coincidence-detection means includes means for affecting the operation of said offensive simulation means to simulate an offensively recovered rebound upon failure of said defensive player and said game object to coincide during a simulated rebound.

12. The hand-held electronic game of claim 9 wherein said defensive simulation means is operable to simulate movement of said simulated target independently of signals transmitted from said manually operable control elements of said offensive and defensive control units.

13. The hand-held electronic game of claim 8, 9, 10, 11, or 12 wherein said target path intersects all of said shot paths.

14. The hand-held electronic game of claim 1 wherein said display panel further includes at least one goalie path of discrete electrically actuatable visual-image-producing devices operable by application thereto of electrical signals to provide images visible on said outer surface of said panel in a path that intersects at least one of said shot paths, wherein said operational-circuit means is electrically connected to said visual-image-producing devices of said goalie path, and wherein said defensive simulation means includes means for actuating various of said visual-image-producing devices of said goalie path to simulate the presence and movement of at least one goalie along said goalie path.

15. The hand-held electronic game of claim 14 wherein said coincidence-detection means includes means for detecting the simulated coincidence of said simulated game object and said simulated goalie and for affecting the operation of said offensive simulation means to simulate an unsuccessful shot upon coincidence of said goalie and said game object during a simulated shot.

16. The hand-held electronic game of claim 15 wherein said offensive simulation means includes means for consecutively actuating said visual-image-producing devices in said shot path to simulate rebounds of said game object from said goal toward said offensive players and wherein said coincidence-detection means affects the operation of said offensive simulation means to simulate a rebound upon coincidence of said goalie and said game object during a simulated shot.

17. The hand-held electronic game of claim 16 wherein said coincidence-detection means includes means for affecting the operation of said offensive simulation means to simulate an offensively recovered rebound upon failure of said defensive player and said game object to coincide during a simulated rebound.

18. The hand-held electronic game of claim 15 wherein said manually operable control elements of said defensive control until include first and second goalie control elements, said defensive simulation means simulating movement of said simulated goalie in a first direction in response to signals transmitted from said first goalie control element and in a second direction in response to signals transmitted from said second goalie control element.

19. The hand-held electronic game of claim 14, 15, 16, 17, or 18 wherein said goalie path intersects all of said shot paths.

20. The hand-held electronic game of claim 1 wherein said pass paths provide an endless composite pass path through each of said offensive-player positions, one direction around said endless path being denominated the clockwise direction and the other being denominated the counterclockwise direction, and wherein one of said manually operable control elements of said offensive control unit is denominated a clockwise pass control element while another of said manually operable control elements of said offensive controlled unit is denominated a counterclockwise pass control element, said offensive simulation means simulating clockwise passes in response to signals transmitted from said clockwise pass control element and simulating counterclockwise passes in response to signals transmitted from said counterclockwise pass control element.

21. The hand-held electronic game of claim 20 wherein said defensive path has two ends, one being denominated a right end and the other being denominated a left end, and wherein said manually operable control elements of said defensive control unit include right and left defensive-player control elements, said defensive simulation means simulating movement of said simulated defensive player toward said right end in response to signals transmitted from said right defensive-player control element and toward said left end in response to signals transmitted from said left defensive-player control element.

22. The hand-held electronic game of claim 1 wherein said defensive-simulation means includes means operable by operation of at least one of said manually operable control elements to defeat the response of said defensive simulation means to said manually operable elements of said defensive control unit and to simulate the presence and movement of said defensive player independently of signals from said manually operable control elements of said defensive control unit.

23. The hand-held electronic game of claim 1 wherein said monitoring means keeps score by adding points to a first total representing the score of a first team and adding points to a second total representing the score of a second team, said monitoring means alternately assigning offensive status to said first and second terms and adding points upon the occurrence of successful shots to said first team when said first team is on offense and to said second team when said second team is on offense, wherein said monitoring means maintains a countdown that begins at a predetermined number at the beginning of each play and is decremented at a predetermined rate until a successful shot occurs, and wherein said monitoring means affects said offensive simulation means and defensive simulation means to terminate the current play and changes the status of each team when said countdown reaches zero.

* * * * *

UNITED STATES PATENT AND TRADEMARK OFFICE

CERTIFICATE OF CORRECTION

PATENT NO. : 4,249,744

DATED : February 10, 1981

INVENTOR(S) : ERIC BROMLEY

It is certified that error appears in the above-identified patent and that said Letters Patent are hereby corrected as shown below:

Column 2, line 48, "inclined" should be -- included --

Column 6, line 24, before "in which" insert -- left --; line 56, "displays" should be -- display --

Column 8, lines 11-12, after "on the" insert -- defensive control board 12. When --

Column 15, line 53, "offfensive" should be -- offensive --

Column 16, line 57, "operation-circuit" should be -- operational-circuit --

Column 17, line 65, "until" should be -- unit --

Column 18, line 53, "terms" should be -- teams --

Signed and Sealed this

*Twenty-third* Day of *June 1981*

[SEAL]

*Attest:*

RENE D. TEGTMEYER

*Attesting Officer*

*Acting Commissioner of Patents and Trademarks*